US005722614A

United States Patent [19]

Wicke

[11] Patent Number: 5,722,614

[45] Date of Patent: Mar. 3, 1998

[54] MISSILE GUIDANCE COMMAND LIMITATION SYSTEM FOR DYNAMIC CONTROLLABILITY CRITERIA

[75] Inventor: Dallas C. Wicke, Garden Grove, Calif.

[73] Assignee: McDonnell Douglas Corporation, Huntington Beach, Calif.

[21] Appl. No.: 741,035

[22] Filed: Oct. 30, 1996

[51] Int. Cl.[6] ..... F42B 15/01

[52] U.S. Cl. ..... 244/3.15

[58] Field of Search ..... 244/3.11, 3.12, 244/3.13, 3.14, 3.15, 3.16, 3.19

[56] References Cited

U.S. PATENT DOCUMENTS

| | | | |
|---|---|---|---|
| 4,883,239 | 11/1989 | Lachmann et al. | 244/3.15 |
| 5,058,836 | 10/1991 | Nobel | 244/3.15 |
| 5,181,673 | 1/1993 | Hubricht et al. | 244/3.12 |
| 5,429,322 | 7/1995 | Waymeyer | 244/3.15 |
| 5,435,503 | 7/1995 | Johnson, Jr. et al. | 244/3.15 |

*Primary Examiner*—Michael J. Carone
*Assistant Examiner*—Theresa M. Wesson
*Attorney, Agent, or Firm*—Harness, Dickey & Pierce, P.L.C.

[57] ABSTRACT

A method and system for limiting missile guidance correction within the physical control capabilities of the missile, while fully utilizing missile maneuver and control capabilities. The method and system of the present invention are applied through missile guidance control electronics. First, a dynamic rate limit is calculated to prevent aerodynamic trim limit overshoot, which is directly related to body attitude rate. Second, a dynamic angle of attack limit is calculated to control aerodynamic trim limit based on thrust deflection and/or aerodynamic control surface deflection. Third, a dynamic angular acceleration limit is calculated to balance control moments produced by mechanisms such as thrust deflection and/or aerodynamic control surface deflection with vehicle moments of inertia. Fourth, the dynamic limit on rate of change of angular acceleration is set to maintain control system margins in terms of maximum enforceable moment in excess of the trim moment at the current angle of attack and maximum slew rate of the thrust deflector.

10 Claims, 3 Drawing Sheets

MISSILE GUIDANCE COMMAND LIMITATION SYSTEM FOR DYNAMIC CONTROLLABILITY CRITERIA

BACKGROUND OF THE INVENTION

The present invention relates generally to ballistic missile defense systems, and more particularly, to a system that limits missile flight path correction procedures to maintain missile maneuvers within acceptable control parameters.

A launched interceptor missile typically follows a set sequence of events. First, the missile is launched based on a prelaunch trajectory solution that satisfies a specified intercept point. Next, as the missile is guided through its boost, or ascent, phase, the system corrects missile errors, navigation errors, atmospheric winds and other sources of error that tend to steer the missile off course. Also, as the missile advances on its flight path after boost phase termination, onboard missile navigation updates are downlinked to a ground based guidance segment to enable the ground based segment to communicate updates on predicted target position to the missile. Subsequent to the missile terminating its boost phase, midcourse and terminal missile flight phase guidance corrections are then made prior to the missile reaching its intercept point.

The missile guidance control electronics typically includes logic that corrects accumulated flight path errors caused by the missile attitude set in accordance with a programmed prelaunch flight solution. However, such a flight correction system is often based on a static approach to guidance command limitation determination. Such command limits tend to overly constrain some phases of flight in order to maintain control in other phases. The result of these, in effect, deferred corrections can be the need for even larger corrections later. These corrections can potentially exceed the control and/or structural capabilities of the missile. Additionally, such a static system may also limit the ability of the missile to avoid an uncontrollable state of flight due to the inherent parameters of the logic. Such static guidance constraint commands are also insensitive to time varying conditions, and thus offer limited flexibility in application as external conditions, such as atmospheric density and windshear are highly variable.

The boost phase of the missile flight presents the most challenging conditions for missile controllability, as conditions such as missile propulsion thrust variation, aerodynamic force variation, thrust misalignment, atmospheric winds, windshear and attitude reference errors result in the need for the most missile guidance correction during this period.

SUMMARY OF THE INVENTION

Accordingly, the present invention provides a method and system for limiting missile guidance correction within the control capabilities of the missile, while fully utilizing missile maneuver and control capabilities. The method and system of the present invention apply for controllability criteria to maintain missile guidance correction commands within the fundamental physical capabilities. First, a dynamic rate limit is calculated to prevent aerodynamic trim limit overshoot, which is directly related to body attitude rate. Second, the dynamic angle of attack limit is calculated to control aerodynamic trim limit based on thrust deflection and/or aerodynamic control surface deflection. Third, a dynamic angular acceleration limit is calculated to control moments applied by the control system such as thrust deflection and/or aerodynamic control surface deflection, to overcome vehicle moments of inertia. Fourth, the dynamic limit on rate of change of angular acceleration is set to maintain control system margins in terms of maximum enforceable moment in excess of the trim moment at the current angle of attack and maximum effective slew rate of the missile thrust vector. The method and system of the present invention are dynamic, thereby providing missile guidance correction on an almost continuous basis, rather than allowing error to accumulate over time before being effectively activated. This approach tends to preempt controllability problems by continuously utilizing the full range of dynamic control margins.

DETAILED DESCRIPTION OF THE PREFERRED EMBODIMENT

Figure 1:
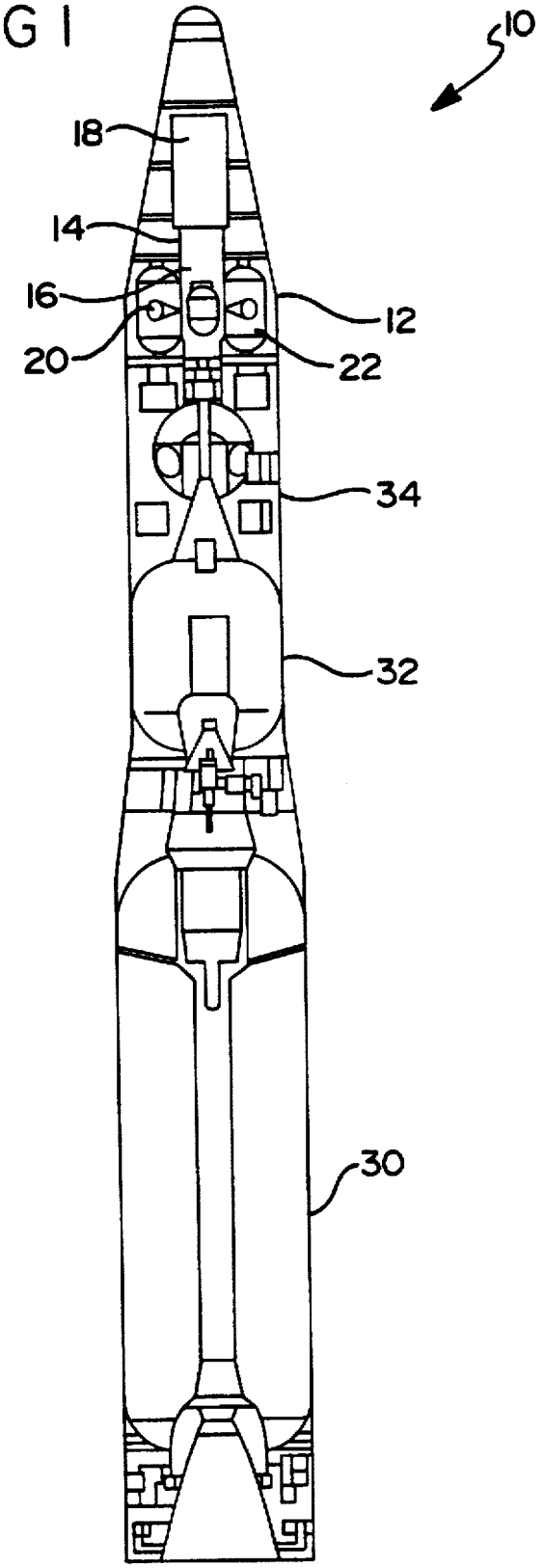
FIG. 1 illustrates a side elevational view, with a portion of its outer shell broken away, of a missile including an integrated boost phase missile guidance system according to the present invention.

Referring now to the drawings, FIG. 1 illustrates a missile 10 including the preferred embodiment of the present invention. The missile shown is a conventional strategic defense missile. However, the present invention may also be implemented in any strategic or tactical defense missiles, including surface to air, or conventional space launch vehicles for guidance and control purposes. For purposes of this description, the term "missile" will be used to refer in general to any launched vehicle capable of being guided by a boost phase missile guidance system including the missile guidance command limitation system of the present invention, as described below.

Further referring to FIG. 1, the missile 10 includes a kill vehicle which constitutes the payload, shown generally at 12. The payload includes guidance control electronics 14 and onboard navigation electronics 16 of the type deployed in conventional strategic and tactical defense missiles. The payload also includes additional components, such as a sensor 18. Also located on the payload is a steering mechanism 20 which may be thrustors or other apparatus for adjusting the attitude or angle of attack of the missile in response to commands from the guidance control electronics 14 as will be described in detail below. The payload also includes a propulsion system 22 including fuel for propelling the kill vehicle to its intended target.

Modular booster stages 30, 32 and 34 are also operatively mounted to the payload 12. Each of the missile booster stages 30, 32 and 34 includes missile fuel and missile propulsion devices such as solid propellant rocket motors for separately propelling the missile along its planned trajectory in three stages, as is well known in the art and as will be described in more detail below.

Each booster stage includes control devices such as thrust vector control or reaction type attitude control systems and/or aerodynamic control devices which respond to the guidance and control electronics located in the payload section.

Figure 2:
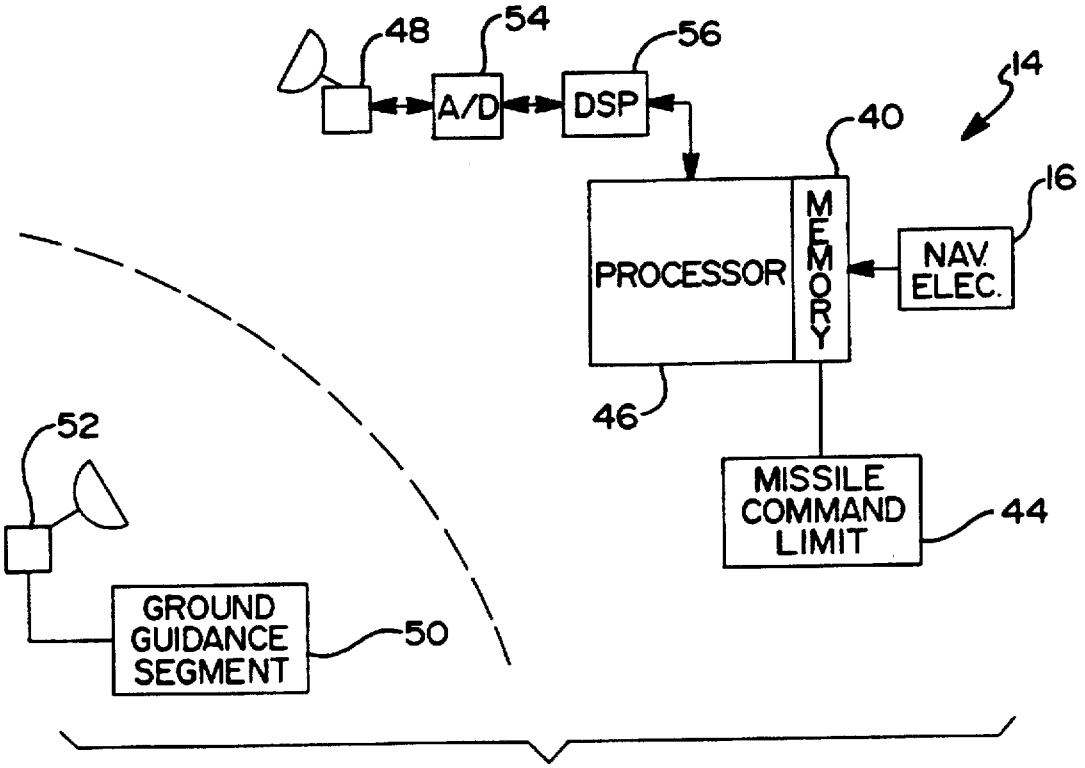
FIG. 2 is a block diagram of the integrated boost phase missile guidance system of the present invention.

Referring to FIG. 2, the diagram of the guidance control electronics 14 is shown. The guidance control electronics includes a memory 40 programmed with the boost phase missile guidance system logic according to the present invention and a processor 46 for executing this logic stored in the memory 40. In particular, the memory 40 and the processor 46 implement the boost phase guidance system including the command limitation system 44 of the present invention and which will each be discussed below in detail. An antenna 48 of the type RF is operatively connected to the processor 32 for providing a link between the onboard guidance control electronics 14 and a ground based control system 50, through a ground based antenna 52. The antenna receives analog signals from a ground based guidance segment 50 and transmitted through the ground based antenna 52. These signals are converted to digital signals through the analog to digital converter 54 and processed through the digital signal processor 56 before being input into the processor 46, as is conventional in the art.

Figure 3:
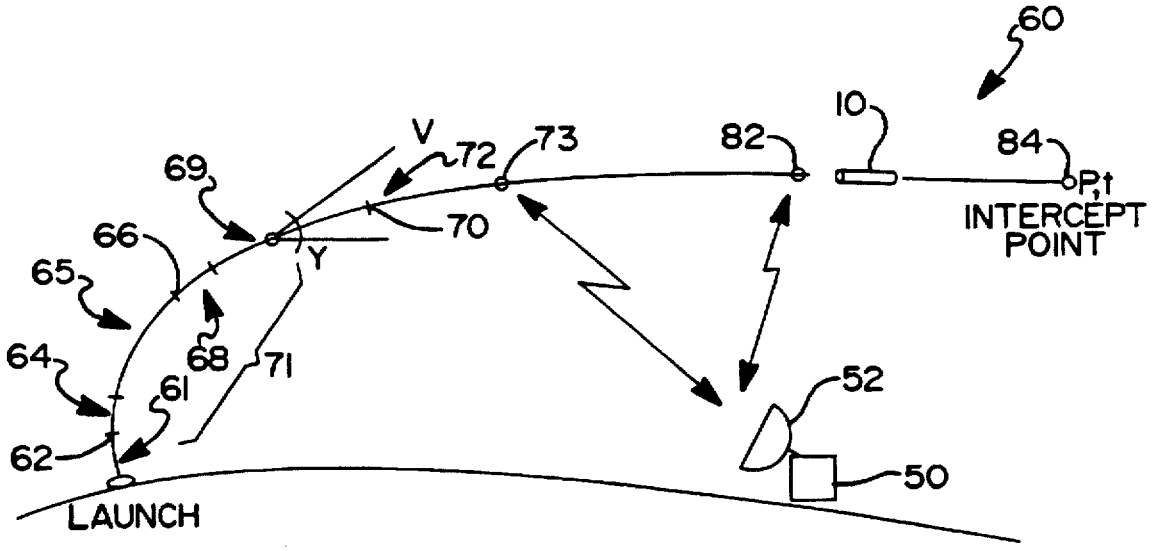
FIG. 3 is a schematic view illustrating the flight path of the missile of FIG. 1.

Referring to FIG. 3, a diagram indicating the various stages of flight of the missile 10 is shown generally at 60 and will now be generally described. Initially, as the missile is launched, the first boost stage 30 is ignited and propels the missile through a burn stage 61 until it reaches a burnout stage 62. Subsequently, the missile enters a coast stage 64 until the second booster stage 32 is ignited. The second booster stage 32 subsequently propels the missile through a burn stage 65 until it reaches a burnout stage 66, at which time the missile enters a second coast stage 68. The missile subsequently remains in the coast stage 68 until the third booster stage 34 is ignited. The third booster stage 34 then propels the missile through a third burn stage 69 until it reaches a burnout stage 70. The combination of the three booster stages will be referred to as the missile boost phase 71. Subsequently, the missile enters a third coast stage 72 until the payload passes through a first node 73, at which time the missile guidance and navigational electronics 14, 16 communicate with the ground based guidance segment 50 through the directional antenna 52 via downlink 80. As will be explained in more detail below, the ground based guidance system 50 subsequently provides an uplink through the directional antenna 52 to the missile at an inflight target update (IFTU) point 82 to provide final target tracking information to the missile to guide the missile to its intercept point 84.

Still referring to FIG. 3, the missile guidance command limitation system of the present invention provides guidance to the missile 10 during its boost phase 71 during which time the missile is progressively propelled by the three booster stages 30, 32 and 34 and where velocity is represented by the velocity vector V. The guidance command limitation system of the present invention is programmed into the memory 40 through FORTRAN programming language or any other software programming language well known to those skilled in the art. The system methodology applies constraints to guidance commands generated by the missile control electronics 14 based on fundamental physical capabilities of the missile structure and control system and rigid body dynamics. The system of the present invention manifests itself in these guidance commands, which in turn are realized in terms of missile attitude and flight path angle y.

Figure 4:
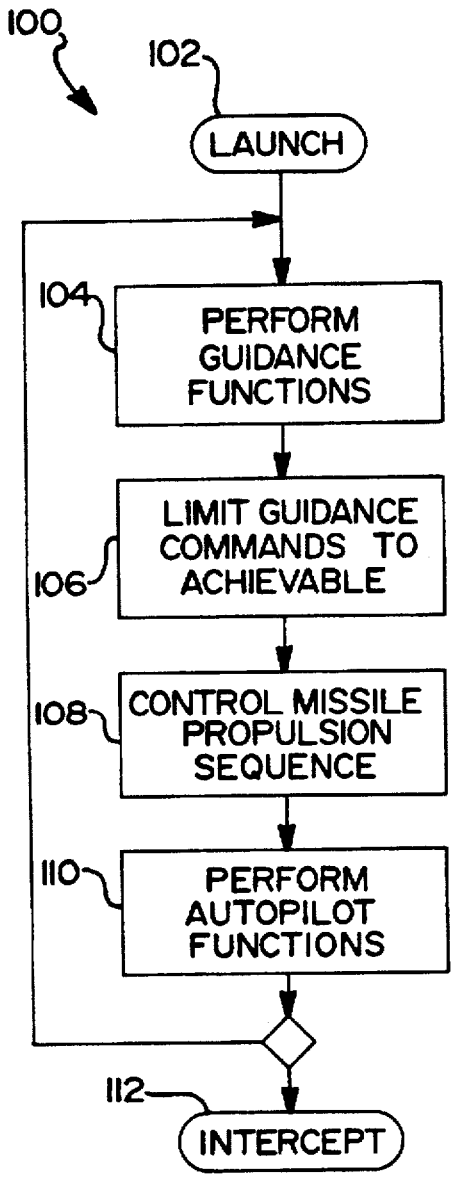
FIG. 4 is a flow diagram illustrating the methodology programmed into the missile guidance electronics of the missile shown in FIG. 1.

Referring to FIG. 4, overall missile guidance control methodology is illustrated generally at 100. After missile launch at step 102, and during the missile boost phase 71 and the subsequent post boost phase, missile guidance electronics 14 perform guidance and control functions indicated in steps 104, 106, 108 and 110. This guidance cycle is repeated as indicated by the feedback path at a rate of, for example, 20 cycles per second throughout the boost phase 71 and at discrete times thereafter. The four steps within each guidance cycle are described as follows for the boost phase: General guidance functions are performed at step 104 to correct the missile flight by applying guidance logic. Subsequently, in accordance with the present invention, guidance limitation logic is implemented at step 106 to limit missile guidance commands within physically achievable parameters. At step 108, missile guidance electronics control missile propulsion sequences by determining appropriate missile stage ignition times and issuing ignition commands. The final step within each guidance cycle is to perform autopilot functions at step 110, such as translation of body attitude commands into control device deflections or control thrustor activations. Subsequently, after boost phase 71 completion, missile guidance control electronics 14 perform further discrete guidance functions such as post boost correction, midcourse correction, and terminal phase guidance to maintain the missile on its course to intercept at step 112.

Figure 5:
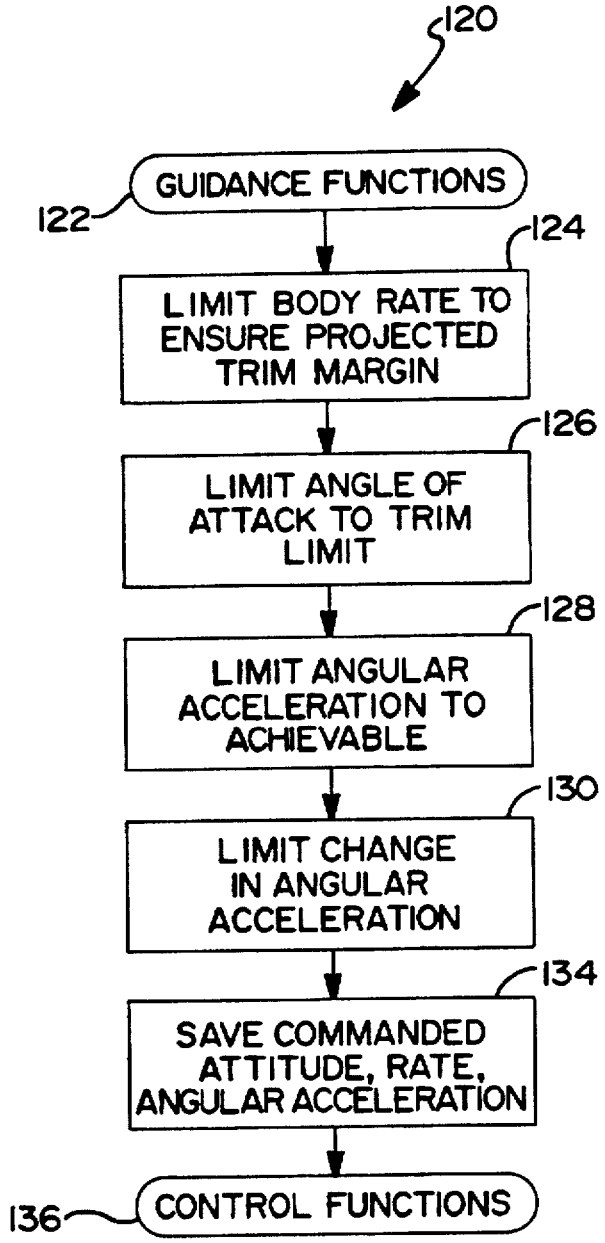
FIG. 5 is a flow diagram illustrating the specific commands programmed into the missile guidance command limitation system of the present invention.

Referring now to FIG. 5, methodology employed by the Guidance Limitation System of the present invention is shown generally at 120. Subsequent to missile control electronics guidance functions being implemented at step 122 to correct missile flight error, the guidance limitation system of the present invention is activated. At step 124, the system limits missile body rate to ensure projected trim margin. By limiting body rate, the system inhibits the missile from overshooting its angle of attack trim capability, which is defined as maximum angle between vehicle centerline and velocity vector relative to atmosphere which vehicle can maintain under control. At step 126, the system of the present invention limits the angle of attack to the missile trim limit. This feature inhibits the missile from exceeding the aerodynamic moment trim capability of the control mechanism, such as thrust vector control (TVC). At step 128, the system limits missile angular acceleration to that which is dynamically achievable by the missile. This feature matches thrust deflection margin, after accounting for aerodynamic trim, to the missile moment of inertia and angular acceleration. In other words, excess control moment capability determines the extent to which missile moment of inertia can be overcome. At step 130, the system limits missile change in angular acceleration to prevent the missile from exceeding its TVC slew rate limit. Each of these features of the system of the present invention remain active in conjunction with one another throughout the boost phase 71 of the missile. As a result, progressively limited attitude commands are output at steps 124, 126, 128 and 130, successively. At step 134, the system saves commanded attitude, rate and angular acceleration data output to the guidance control electronics for use in command limiting computations in the subsequent missile guidance cycle. Preferably, the system cycles through the limitation command parameters at approximately 20–60 cycles per second in conjunction with missile navigation data updates from the navigation control electronics. At step 136, data is output from the system of the present invention to the missile guidance control electronics for control of the missile, and in particular, the missile attitude.

Still referring to FIG. 5, each of the particular command limit features 124–130 of the present invention will be discussed in more detail. Referring to step 124, the system of the present invention limits missile body rate to ensure adequate margin of the control electronics in its ability to trim aerodynamic moments projected ahead in time to a missile peak angle of attack. It is crucial that the vehicle body rate is limited in such a manner, as projected aerodynamic moments account for missile control electronics response characteristics, and are based on the assumption that maximum control would be applied to overcome missile attitude rate. By limiting the missile body rate, overshooting of the angle of attack control limit at a later time is avoided.

Referring to step 128, the system of the present invention also limits the instantaneous angle of attack command of the missile control electronics to maintain consistency with the aerodynamic moment trim capability of the missile. The aerodynamic trim limit capability is based on attitude thruster, thrust vector deflection and/or aerodynamic control surface deflection. The angle of attack must not exceed that which the control mechanism is capable of maintaining with counter moments or the result could be the missile tumbling out of control. The instantaneous angle of attack command must be constrained, as it is essential that this particular application be dynamic due to the high variability of atmospheric density and other external forces.

Referring to step 128, the system of the present invention also limits angular acceleration to that physically achievable by the missile. The generated limited command is fundamentally related to the moments realized by the missile guidance control electronics through the control mechanism and the missile moment of inertia. A present missile attitude command is constrained with respect to a stored history of prior attitude commands to ensure that the missile angular acceleration will not exceed the capability of the missile control system. Thrust moments realized through the thrust vector control and/or reaction control thrustors and/or aerodynamic control moments realized through aerodynamic control devices must be capable of overcoming the moment of inertia.

Referring to step 130, the rate of change of angular acceleration limit inhibits the missile from exceeding the thrust vector control slew rate limit, which is the limit on the angular rate of change of the thrust vector. This constraint computation is directly proportional to the maximum enforceable moment in excess of the trim moment at the missile current instantaneous angle of attack.

As referenced above, the guidance constraint computations are programmed into the memory 40 and are executed by the processor 46 in conjunction with the missile guidance control electronics 14 and translated into progressively limited missile attitude commands at steps 124, 126, 128 and 130. As referenced in block 134 in FIG. 5, missile current attitude, attitude rate and angular acceleration are saved for use in determining future missile guidance constraint computations. However, it is not necessary to utilize feedback of actual missile attitudes from the navigation system, thus avoiding potential instability in the guidance loop caused by such feedback.

The methodology of the present invention can be expressed in mathematical form for the example of a missile with thrust vector control as follows, with equations appearing in order of solution:

Attitude Rate Limit $m_\delta = FX_T/Iy$ $\theta_{margin} = m_\delta \delta_{margin}/2$ $\dot{\theta}_{lim} = [\theta_{margin}\ \alpha_{margin}]^{1/2}$ $|\dot{\theta}_c| \leqq \dot{\theta}_{lim}$ $\Delta\theta_c \leqq \dot{\theta}_c \Delta t$ where $m_\delta$=moment slope per thrust deflection F=missile axial thrust $X_T$=distance of thrust chamber from missile center of gravity Iy=missile moment of inertia $\theta_{margin}$=available margin in angular acceleration $\delta_{margin}$=available margin in thrust deflection after moments are trimmed at current angle of attack $\theta_{lim}$=attitude rate limit $\alpha_{margin}$=difference between angle of attack capability and current angle of attack $\dot{\theta}_c$=rate of change of attitude command $\Delta\theta_c$=change in attitude command relative to prior guidance cycle $\Delta t$=guidance cycle time interval and wherein the preferred implementation of available margins is given by $\Delta\alpha = \alpha_g - \alpha_{clast}$ $\alpha_{margin} = |\alpha_{cap}\ \mathrm{sign}(\Delta\alpha) - \alpha_{clast}|$ $\delta_{margin} = [0.5\ \alpha_{margin}/\alpha_{cap}]\delta_m + 0.5\ [\delta_s - \delta_m]$ where $\Delta\alpha$=desired change in angle of attack command $\alpha_g$=angle of attack command computed by guidance subsystem from guidance equations $\alpha_{clast}$=net angle of attack command from prior guidance cycle $\alpha_{cap}$=angle of attack capability=$\alpha$lim as computed under Angle of Attack Limit section below $\delta_m$=maximum thrust deflection enforced $\delta_s$=physical stop maximum thrust deflection angle Angle of Attack Limit $m_\alpha = A\ q\ C_{N\alpha}(X_{cp} - X_{cg})/Iy$ $\alpha_{lim} = |\delta_m m_\delta / m_\alpha|$ $|\alpha| \leqq \alpha_{lim}$ $\theta_c = \gamma + \alpha$ where $m_\alpha$=moment slope per angle of attack A=aerodynamic reference area q=dynamic pressure (aerodynamic)

$C_{N\alpha}$=normal force coefficient slope per angle of attack $X_{cp}$=location of aerodynamic center of pressure $X_{cg}$=location of missile center of gravity Iy=missile moment of inertia $\alpha_{lim}$=angle of attack limit $\delta_m$=maximum thrust deflection $m_{67}$ =moment slope per thrust deflection $\alpha$=commanded angle of attack $\theta_c$=commanded attitude $\gamma$=flight path angle Angular Acceleration Limit $\theta_{lim} = c\ m_\delta \delta_m$ $|\theta_c| \leqq \theta_{lim}$ $\theta_c$ constrained accordingly where $\theta_{lim}$=angular acceleration limit c=coefficient providing margin $m_\delta$=moment slope per thrust deflection $\delta_m$=maximum thrust deflection $\theta_c$=second derivative of attitude command with respect to time $\theta_c$=commanded attitude Limit on Rate of Change of Angular Acceleration $k_c = k_\theta k_q k_d [\Delta t]^2$ $\Delta\theta_{lim} = \dot{\delta}_{max} m_\delta / k_c$ $|\Delta\theta_c| \leqq \Delta\theta_{lim}$ $\theta_c$ constrained accordingly where $k_c$=product of control system gains $k_\theta$=control system attitude gain $k_q$=control system attitude rate gain $k_d$=control system thrust deflection rate gain $\Delta t$=guidance cycle time interval $\Delta\theta_{lim}$=limit on change in angular acceleration $\delta_{max}$=maximum thrust deflection rate (slew rate)

$m_\delta$=moment slope per thrust deflection $\Delta\theta_c$=change in second derivative of attitude command with respect to time $\theta_c$=commanded attitude As should be understood from reading the foregoing description, the missile guidance command limitation system of the present invention maintains guidance correction demands output by system guidance control electronics within physically achievable missile parameters. It is contemplated that the system of the present invention could be implemented in any missile guidance control system regardless of the particular guidance commands. Thus, the system of the present invention poses limits on guidance correction systems, while allowing relatively aggressive guidance corrections to be made within the physical capability of the system. The system of the present invention may be programmed into existing missile guidance electronics, and as such may be integrated into the system as part of an overall missile guidance system.

While the above detailed description describes the preferred embodiment of the present invention, the invention is susceptible to modification, variation and alteration without deviating from the scope and fair meaning of the subjoined claims.

What is claimed is:

1. A method of guiding a missile to an intended target, comprising the steps of:

providing missile guidance electronics;

storing a plurality of algorithms for computing missile guidance commands, said commands being selectively activated by said missile guidance control electronics;

prior to applying said missile guidance commands, using said missile guidance control electronics to generate a plurality of dynamic control limiting commands including:

commands limiting missile body rate to ensure a projected trim margin to thereby prevent said missile from overshooting its angle of attack trim capability; and commands limiting missile angular acceleration to that which is dynamically achievable by said missile; and applying said plurality of dynamic control limiting commands to said missile guidance commands to produce a plurality of dynamically limited commands which are adapted to control said missile within physical parameters achievable by said missile.

2. The method of claim 1, wherein said step of generating a plurality of dynamic control limiting commands comprises the step of generating a missile control limiting command that limits missile body rate.

3. The method of claim 1, wherein said step of generating a plurality of dynamic control limiting commands comprises the step of generating a command that limits missile instantaneous angle of attack.

4. The method of claim 1, further comprising the steps of:

providing missile navigation electronics for determining missile navigation data; and transmitting said missile navigation data from said missile navigational electronics to said missile guidance electronics to update said missile guidance electronics on missile flight path and position.

5. A missile system, comprising:

a missile; and missile control electronics, comprising:

a memory programmed with a plurality of missile guidance commands and a plurality of missile guidance correction commands for controlling guidance of said missile to its intended target, said memory also being programmed with a plurality of missile guidance correction limit computations limiting operation of said missile guidance correction commands within capability parameters determined in real time;

a processor for selectively activating said plurality of missile guidance commands and said plurality of missile guidance correction commands and, subsequent to activation of said missile guidance correction commands, activating said plurality of missile guidance correction limit computations in response to dynamically sensed missile flight data to output guidance commands to guide said missile to said intended target;

said plurality of missile guidance correction limit computations including:

computations to limit missile body rate to ensure a projected trim margin for said missile;

computations to limit missile angular acceleration to that which is dynamically achievable by said missile;

computations to limit an angle of attack of said missile to said missile trim limit; and computations to limit missile rate of change in angular acceleration; and missile guidance means for adjusting flight of said missile in response to said guidance commands output from said processor.

6. The system of claim 5, wherein said plurality of missile guidance correction limit computations comprises a command that limits missile body rate.

7. The system of claim 5, wherein said plurality of missile guidance correction limit computations comprises a command that limits missile instantaneous angle of attack.

8. The system of claim 5, wherein said plurality of missile guidance correction limit computations comprises a command that limits missile angular acceleration.

9. The system of claim 5, wherein said plurality of missile guidance correction limit computations comprises a command that limits missile rate of change of angular acceleration.

10. The system of claim 5, wherein said processor cycles through said limit commands at approximately 20–60 cycles per second to provide said limit commands in real time to said missile guidance means.

* * * * *

UNITED STATES PATENT AND TRADEMARK OFFICE

CERTIFICATE OF CORRECTION

PATENT NO : 5,722,614

DATED : March 3, 1998

INVENTOR : Dallas C. Wicke

It is certified that error appears in the above-identified patent and that said Letters Patent are hereby corrected as shown below:

ON THE TITLE PAGE insert the following statement after the title:

"This invention was made with Government support under contract DASG60-90-C-0166 awarded by the U.S. Army. The Government has certain rights in this invention"

Signed and Sealed this

Fifteenth Day of May, 2001

*Attest:*

Nicholas P. Godici

NICHOLAS P. GODICI

*Attesting Officer*

*Acting Director of the United States Patent and Trademark Office*